US010228098B2

(12) United States Patent
Berkeljon

(10) Patent No.: US 10,228,098 B2
(45) Date of Patent: Mar. 12, 2019

(54) LIGHTING SYSTEM AND METHOD OF LIGHTING

(71) Applicant: Outsight Pty Ltd, Rosebery, New South Wales (AU)

(72) Inventor: Tama Berkeljon, Naremburn (AU)

(73) Assignee: Outsight Pty Ltd., New South Wales (AU)

( * ) Notice: Subject to any disclaimer, the term of this patent is extended or adjusted under 35 U.S.C. 154(b) by 0 days.

(21) Appl. No.: 15/301,873

(22) PCT Filed: Apr. 7, 2015

(86) PCT No.: PCT/AU2015/000207

§ 371 (c)(1),
(2) Date: Oct. 4, 2016

(87) PCT Pub. No.: WO2015/149118

PCT Pub. Date: Oct. 8, 2015

(65) Prior Publication Data

US 2017/0030533 A1 Feb. 2, 2017

(30) Foreign Application Priority Data

Apr. 4, 2014 (AU) ..... 2014901250

(51) Int. Cl.
*F21S 2/00* (2016.01)
*F21K 9/00* (2016.01)
(Continued)

(52) U.S. Cl.
CPC ..... *F21S 2/005* (2013.01); *F21K 9/00* (2013.01); *F21V 3/00* (2013.01); *F21V 21/30* (2013.01);
(Continued)

(58) Field of Classification Search
CPC .. F21S 2/005; F21K 9/00; F21V 21/30; F21V 29/51; F21V 29/763; F21V 29/773; F21V 29/77; F21V 3/00; F21V 23/005
See application file for complete search history.

(56) References Cited

U.S. PATENT DOCUMENTS 7,331,691 B2 2/2008 Livesay et al.
2009/0097241 A1* 4/2009 Xu ..... F21K 9/00 362/234

(Continued)

FOREIGN PATENT DOCUMENTS

CN 101408300 A 4/2009

*Primary Examiner* — Thomas M Sember
(74) *Attorney, Agent, or Firm* — BainwoodHuang

(57) ABSTRACT

A lighting system (1) includes six equally circumferentially spaced apart and radially diverging light modules (3, 4, 5, 6, 7 and 8) for emitting light. The modules are disposed closely adjacent to each other and the light collectively defines a beam of light that is directed along a primary axis (9) in a first axial direction (10). A plurality of heat conductors, in the form of six like sets (13, 14, 15, 16, 17 and 18) of heatpipes, allow heat to be drawn away from respective modules (3, 4, 5, 6, 7 and 8). Each set of heatpipes includes eight separate continuous heatpipes, and each heatpipe in each set includes a first end (19) that is thermally connected to the relevant module and a second end (20) that is radially spaced apart from the first end (19). Six heat exchange elements, in the form of six respective like segmented arrays (23, 24, 25, 26, 27 and 28) of radially diverting heat exchange fins, are radially spaced apart from the modules and are thermally connected with the second ends (20) of the heatpipes in the relevant sets for allowing the heat to be dissipated from those heatpipes. The arrays (23, 24, 25, 26, 27 and 28) of heat exchange fins extend radially away from the respective modules (3, 4, 5, 6, 7 and 8).

20 Claims, 18 Drawing Sheets

(51) Int. Cl.

| | |
|---|---|
| ***F21V 21/30*** | (2006.01) |
| ***F21V 29/51*** | (2015.01) |
| ***F21V 29/76*** | (2015.01) |
| ***F21V 29/77*** | (2015.01) |
| ***F21V 3/00*** | (2015.01) |
| ***F21V 23/00*** | (2015.01) |
| *F21W 131/406* | (2006.01) |
| *F21Y 115/10* | (2016.01) |

(52) U.S. Cl.

CPC ..... *F21V 23/005* (2013.01); *F21V 29/51* (2015.01); *F21V 29/763* (2015.01); *F21V 29/77* (2015.01); *F21V 29/773* (2015.01); *F21W 2131/406* (2013.01); *F21Y 2115/10* (2016.08)

(56) References Cited

U.S. PATENT DOCUMENTS

| | | | | |
|---|---|---|---|---|
| 2012/0098401 | A1* | 4/2012 | Yu | F21V 29/004 313/46 |
| 2013/0176707 | A1 | 7/2013 | Audette et al. | |

* cited by examiner

LIGHTING SYSTEM AND METHOD OF LIGHTING

FIELD OF THE INVENTION

The present invention relates to a lighting system and a method of lighting.

The invention has been developed primarily for providing space lighting in studios and film sets and will be described hereinafter with reference to such applications. However, it will be appreciated that the invention is not limited to these particular fields of use and is also applicable to lighting systems and methods of lighting used in other applications such as agriculture, automotive and portable road lighting systems.

BACKGROUND

Any discussion of the background art throughout the specification should in no way be considered as an admission that such art is widely known or forms part of common general knowledge in the field.

There are available a wide variety of space lighting systems. These have more conventionally included a circular array of six tungsten lights mounted to a singular generally circular plate. The plate is suspended or otherwise mounted to a gantry, a stand, or another support frame to provide the required lighting. While these lighting systems provide a good quality of light, to provide the required light intensity they need to draw considerable current and, consequently, they generate considerable heat. Moreover, in an attempt to allow sufficient passive cooling of the lights—that is, to avoid the need for active cooling—the six lights are spaced apart, which increases the overall volume of the system and makes colour mixing difficult to achieve. Accordingly, where different colours are required use is made of multiple lights, skirts, filters and other additional equipment and accessories.

As a partial solution to the above limitations LED space lights have been developed, such as that disclosed in US 20130176707. This particular space light makes use of two metal plates between which six radially divergent LED light modules are fixedly located. The plates include aligned apertures to mimic the shape and configuration of a traditional film reel, and the light modules are viewable through those apertures and project light through those apertures. In practice, the metal plates have a radius that is approximately equal to the circular plate that has been used in the earlier existing tungsten light systems to provide a degree of familiarity to those using and operating the lights, and to accommodate existing accessories. However, this system is of only relatively low power (typically about 500 Watts to 700 Watts) to remain passively cooled. Accordingly, it is limited in application or, alternatively, a greater number of such units are required to be used simultaneously to provide the desired level of lighting.

A further alternative to the more conventional tungsten lights is provided by a square array of LED emitters. Such a system is supplied by Production Resource Group, LLC and sold under the model designation OHM™. This system is rated at typically 500 Watts, notwithstanding the use of active cooling with fans. That is, the amount of light produced is relatively low, and the noise level higher than is typical for a passively cooled system. The latter factor, in a studio environment in particular, is highly disadvantageous.

Accordingly, there is a need in the art for an improved lighting system and a method of lighting.

SUMMARY OF THE INVENTION

It is an object of the present invention to overcome or ameliorate at least one of the disadvantages of the prior art, or to provide a useful alternative.

According to a first aspect of the invention there is provided a lighting system including:

a plurality of modules for emitting light, wherein the modules are adjacent to each other and the light collectively defines a beam of light that is directed along a primary axis in a first direction;

a plurality of heat conductors for allowing heat to be drawn away from the modules, each heat conductor having a first end that is thermally connected to one of the modules and a second end that is spaced apart from the first end; and a plurality of heat exchange elements that are spaced apart from the modules and thermally connected with the second ends for allowing the heat to be dissipated from the heat conductors, wherein the elements extend radially away from the modules.

In an embodiment the first end and the second end of each heat conductor is connected to the first end and the second end of another heat conductor to form a loop.

In an embodiment the modules each include a window through which light is emitted and the windows extend substantially along a common plane.

In an embodiment the modules each include respective arrays of LEDs for generating the light that is emitted through the corresponding window.

In an embodiment the common plane is normal to the primary axis.

In an embodiment the windows are covered by respective lenses.

In an embodiment the plurality of modules includes an even number of modules arranged in an array, wherein each module in the array is adjacent to at least two other modules.

In an embodiment the array is a circular array and diametrically opposed pairs of modules in the array are like modules.

In an embodiment like modules emit light of substantially the same colour.

In an embodiment the heat exchange elements are axially offset from the modules in a second direction opposite to the first direction.

In an embodiment the heat exchange elements radially overlap the modules.

In an embodiment the system includes a mounting hub for connecting to the modules.

In an embodiment the modules extend radially outwardly from the hub.

In an embodiment the modules extend radially away from each other.

In an embodiment the modules are equally circumferentially spaced about the hub.

In an embodiment the hub includes a hub housing for defining a hub cavity, the modules include respective module housing defining module cavities, and electrical equipment is able to extend between the hub cavity and the module cavities.

In an embodiment each module housing includes an engagement face having a module aperture and the hub housing includes an outer face having a plurality of hub apertures corresponding to the number of modules, the outer face being engagable with the engagement faces such that each module aperture is aligned with a respective hub aperture.

In an embodiment the outer face is sealingly engageable with the engagement faces.

In an embodiment the system includes a mounting formation for allowing mounting of the system to another object.

In an embodiment the mounting formation includes a mounting frame.

In an embodiment the mounting frame includes at least one circumferential member and a plurality of spokes that are connected to the circumferential member and which extend radially inwardly.

In an embodiment the system includes a mounting hub for connecting to the modules, wherein the spokes are connected to the hub.

In an embodiment the circumferential element includes two circumferential members that lie radially outwardly from the heat exchange elements and which are axially spaced apart.

According to a second aspect of the invention there is provided a lighting system including:

a mounting hub;

a plurality of modules that are connected to the hub for emitting light, wherein the modules are adjacent to each other and the light collectively defines a beam of light that is directed along a primary axis in a first direction;

a plurality of heat conductors for allowing heat to be drawn away from the modules, each heat conductor having a first end that is thermally connected to one of the modules and a second end that is spaced apart from the first end; and a plurality of heat exchange elements that are spaced apart from the modules and thermally connected with the second ends for allowing the heat to be dissipated from the heat conductors.

In an embodiment the modules extend radially outwardly from the hub.

In an embodiment the modules extend radially away from each other.

In an embodiment the modules are equally circumferentially spaced about the hub.

In an embodiment the hub includes a hub housing for defining a hub cavity, the modules include respective module housings defining module cavities, and electrical equipment is able to extend between the hub cavity and the module cavities.

In an embodiment each module housing includes an engagement face having a module aperture and the hub housing includes an outer face having a plurality of hub apertures corresponding to the number of modules, the outer face being engagable with the engagement faces such that each module aperture is aligned with a respective hub aperture.

In an embodiment the outer face is sealingly engageable with the engagement faces.

In an embodiment the elements extend radially away from the modules.

According to a third aspect of the invention there is provided a lighting system including:

a mounting hub;

a plurality of modules that are connected to the hub for emitting light, wherein the modules are adjacent to each other and the light collectively defines a beam of light that is directed along a primary axis in a first direction, the modules extending radially outwardly from the hub;

a plurality of heat conductors for allowing heat to be drawn away from the modules, each heat conductor having a first end that is thermally connected to one of the modules and a second end that is spaced apart from the first end; and a plurality of heat exchange elements that are spaced apart from the modules and thermally connected with the second ends for allowing the heat to be dissipated from the heat conductors.

In an embodiment the modules extend radially away from each other.

In an embodiment the modules are equally circumferentially spaced about the hub.

In an embodiment the hub includes a hub housing for defining a hub cavity, the modules include respective module housing defining module cavities, and electrical equipment is able to extend between the hub cavity and the module cavities.

In an embodiment each module housing includes an engagement face having a module aperture and the hub housing includes an outer face having a plurality of hub apertures corresponding to the number of modules, the outer face being engagable with the engagement faces such that each module aperture is aligned with a respective hub aperture.

In an embodiment the outer face is sealingly engageable with the engagement faces.

In an embodiment the elements extend radially away from the modules.

According to a fourth aspect of the invention there is provided a module for a lighting system, the module including:

a housing for a light source;

a heat exchange element that is spaced apart from the housing; and a plurality of heat conductors extending between the housing and the element for allowing heat to be drawn away from the housing, each heat conductor having a first end that is thermally connected to the housing and a second end that is spaced apart from the first end and thermally connected to the element.

In an embodiment the first end and the second end of each heat conductor is connected to the first end and the second end of another heat conductor to form a loop.

In an embodiment the heat exchange element includes a plurality of fins.

In an embodiment the fins are integrally formed.

In an embodiment the heat exchange element encapsulates the heat conductors at or adjacent to the second ends.

In an embodiment the heat exchange element sandwiches the heat conductors at or adjacent to the second ends.

In an embodiment the housing is also for other electrical equipment associated with the light source.

In an embodiment the housing includes an engagement face for sealingly engaging with a mounting hub.

In an embodiment the housing includes a module aperture in the engagement face and the hub includes a hub aperture that, in use, is aligned with the module aperture for allowing electrical equipment to extend between the housing and the hub.

According to a fifth aspect of the invention there is provided a lighting system including:

a plurality of modules for emitting light, wherein the modules are adjacent to each other and the light collectively defines a beam of light that is directed along a primary axis in a first direction;

a plurality of heat exchange elements that are spaced apart from the modules for allowing the heat to be dissipated from the modules; and a mounting formation for allowing mounting of the system to another object, the mounting formation includes at least one circumferential member and a plurality of spokes that are connected to the circumferential member and which extend radially inwardly.

In an embodiment the system includes a mounting hub for connecting to the modules, wherein the spokes are connected to the hub.

According to a sixth aspect of the invention there is provided a method of providing lighting, the method including the steps of:

providing a plurality of modules for emitting light, wherein the modules are adjacent to each other and the light collectively defines a beam of light that is directed along a primary axis in a first direction;

allowing heat to be drawn away from the modules by a plurality of heat conductors, each heat conductor having a first end that is thermally connected to one of the modules and a second end that is spaced apart from the first end; and providing a plurality of heat exchange elements that are spaced apart from the modules and thermally connected with the second ends for allowing the heat to be dissipated from the heat conductors, wherein the elements extend radially away from the modules.

According to a seventh aspect of the invention there is provided a method of lighting including the steps of:

providing a mounting hub;

connecting a plurality of modules to the hub, wherein the modules are adjacent to each other and emit light that collectively defines a beam of light that is directed along a primary axis in a first direction;

allowing heat to be drawn away from the modules by a plurality of heat conductors, each heat conductor having a first end that is thermally connected to one of the modules and a second end that is spaced apart from the first end; and providing a plurality of heat exchange elements that are spaced apart from the modules and thermally connected with the second ends for allowing the heat to be dissipated from the heat conductors.

According to an eighth aspect of the invention there is provided a method of lighting including the steps of:

providing a mounting hub;

connecting a plurality of modules to the hub which extend radially outwardly from the hub, wherein the modules are adjacent to each other and emit light that collectively defines a beam of light that is directed along a primary axis in a first direction;

allowing heat to be drawn away from the modules by a plurality of heat conductors, each heat conductor having a first end that is thermally connected to one of the modules and a second end that is spaced apart from the first end; and providing a plurality of heat exchange elements that are spaced apart from the modules and thermally connected with the second ends for allowing the heat to be dissipated from the heat conductors.

According to a ninth aspect of the invention there is provided a method of manufacturing a module for a lighting system, the method including the steps of:

providing a housing for a light source;

spacing a heat exchange element apart from the housing; and extending a plurality of heat conductors between the housing and the element for allowing heat to be drawn away from the housing, wherein each heat conductor has a first end that is thermally connected to the housing and a second end that is spaced apart from the first end and thermally connected to the element.

According to a tenth aspect of the invention there is provided a lighting system including:

a plurality of modules for emitting light, wherein the modules are adjacent to each other and the light collectively defines a beam of light that is directed along a primary axis in a first direction;

a plurality of heat conductors for allowing heat to be drawn away from the modules, each heat conductor having a first end that is thermally connected to one of the modules and a second end that is spaced apart from the first end;

a plurality of heat exchange elements that are spaced apart from the modules and thermally connected with the second ends for allowing the heat to be dissipated from the heat conductors; and a support frame extending axially and radially beyond the heat exchange elements.

In an embodiment the support frame includes at least one first member for extending circumferentially about the heat exchange elements and at least one second member for extending radially inwardly from the at least one first member.

In an embodiment the first member includes two circumferentially extending axially spaced apart elements.

In an embodiment the at least one second members extend axially beyond the heat exchange elements.

Reference throughout this specification to "one embodiment", "some embodiments" "an embodiment", "an arrangement", "one arrangement" means that a particular feature, structure or characteristic described in connection with the embodiment or arrangement is included in at least one embodiment or arrangement of the present invention. Thus, appearances of the phrases "in one embodiment", "in some embodiments", "in an embodiment", "in one arrangement", or "in and arrangement" in various places throughout this specification are not necessarily all referring to the same embodiment or arrangement, but may. Furthermore, the particular features, structures or characteristics may be combined in any suitable manner, as would be apparent to one of ordinary skill in the art from this disclosure, in one or more embodiments or arrangements.

As used herein, and unless otherwise specified, the use of the ordinal adjectives "first", "second", "third", etc., to describe a common object, merely indicate that different instances of objects in a class of objects are being referred to, and are not intended to imply that the objects so described must be in a given sequence, either temporally, spatially, in ranking, in importance or in any other manner.

Unless defined otherwise, all technical and scientific terms used herein have the same meaning as commonly understood by those of ordinary skill in the art to which the invention belongs. The articles "a" and "an" are used herein to refer to one or to more than one (that is, to at least one) of the grammatical object of the article unless the context requires otherwise. By way of example, "an element" normally refers to one element or more than one element. The term "about" is used herein to refer to quantities that vary by as much as 30%, preferably by as much as 20%, and more preferably by as much as 10% to a reference quantity. In the claims below and the description herein, any one of the terms "comprising", "comprised of" or "which comprises" is an open term that means including at least the elements/features that follow, but not excluding others. Thus, the term "comprising", when used in the claims, should not be interpreted as being limitative to the means or elements or steps listed thereafter. For example, the scope of the expression "a device comprising A and B" should not be limited to devices consisting only of elements A and B. Any one of the terms "including" or "which includes" or "that includes" as used herein is also an open term that also means including at least the elements/features that follow the term, but not excluding others. Thus, "including" is synonymous with and means "comprising".

As used herein, the term "exemplary" is used in the sense of providing examples, as opposed to indicating quality. That is, an "exemplary embodiment" is an embodiment provided as an example, as opposed to necessarily being an embodiment of exemplary quality.

In the context of this patent specification the term 'electrical equipment' is intended to refer broadly to electrical and electronic components or combinations of components. This includes electrical cabling and wiring for data, power or other functions, electrical components, either active or passive, circuit boards, and other electrical or electronic components. It will also be appreciated that the singular also includes the plural except where the context otherwise indicates.

Where reference is made to an 'axis' for beam of light this is to be interpreted as a generally central path along which the light is directed in use. Accordingly, the term 'axis' may be a notional axis to indicate the practical central path of a beam of diffuse light. That is, the term can be the actual centre point of the light source, or the notional centre point of a plurality of light sources. However, the term may not necessarily be used in a strict geometric sense and can, for example, be determined by measuring luminous flux per unit area. By way of example, when measuring the spread of a beam of light at a given distance from the light, the axis is determined by the point of maximum illuminance at that given distance. The radial edge of the beam is then determined by the half power point of the beam directly radially outward from the axis at that given distance. This then allows an angle of spread to be calculated.

BRIEF DESCRIPTION OF THE DRAWINGS

Embodiments of the invention will now be described, by way of example only, with reference to the accompanying drawings in which.

DETAILED DESCRIPTION

Described herein are a lighting system and a method of lighting that is embodied exemplarily as a system and a method for space lighting.

Figure 1:
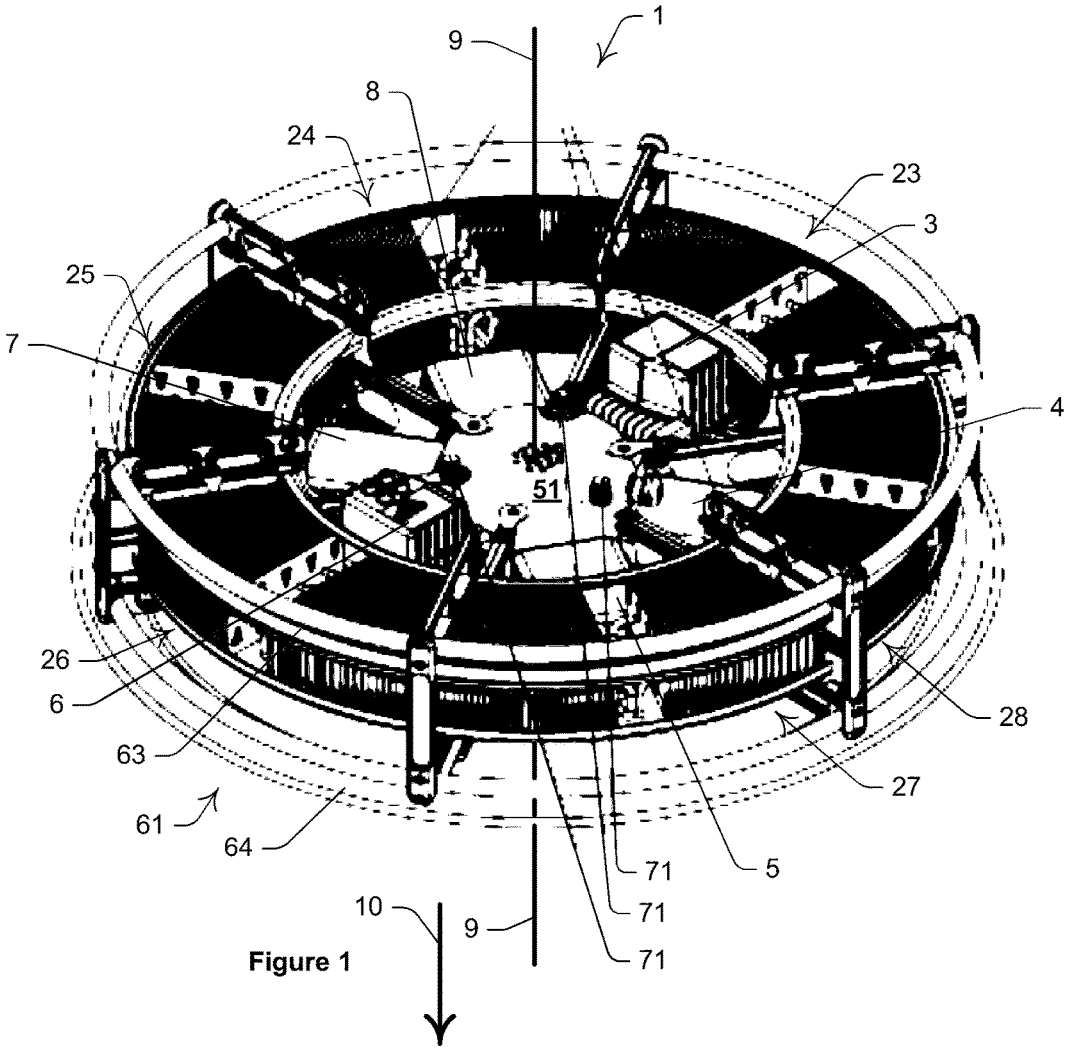
FIG. 1 is a top perspective view of a space light system according to an embodiment of the invention.
Figure 2:
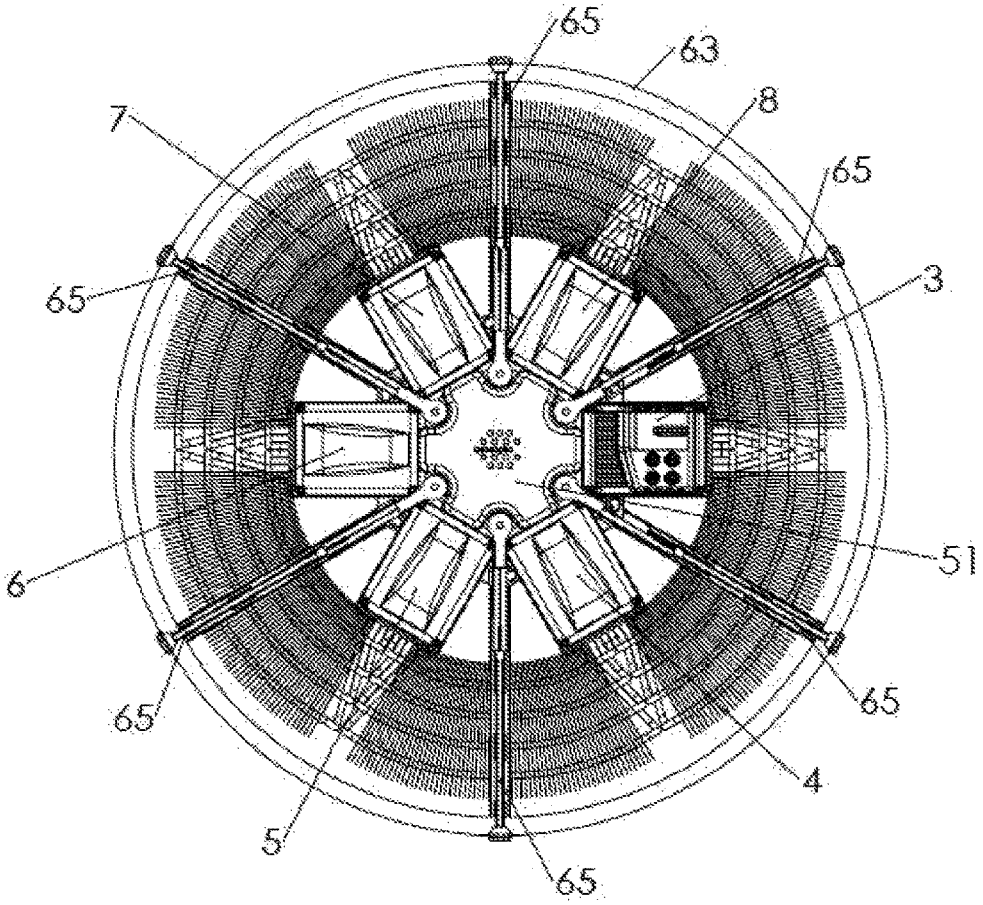
FIG. 2 is a plan view of the system of FIG. 1.
Figure 3:
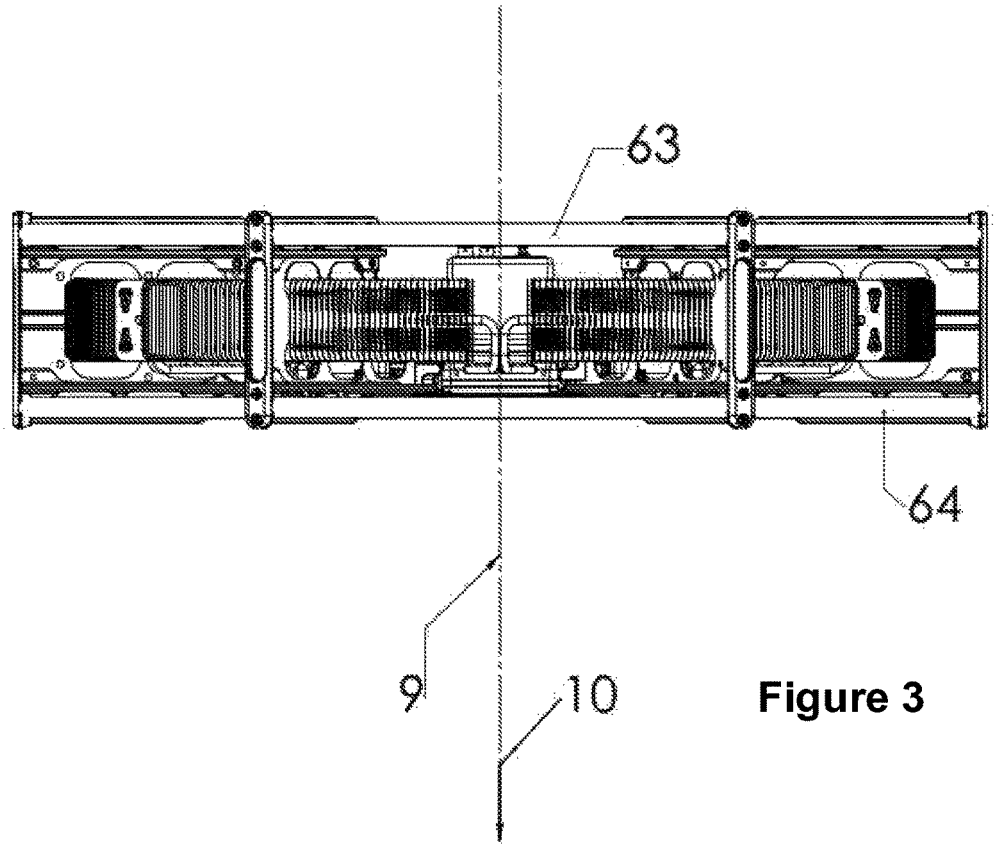
FIG. 3 is a side view of the system of FIG. 1.
Figure 5:
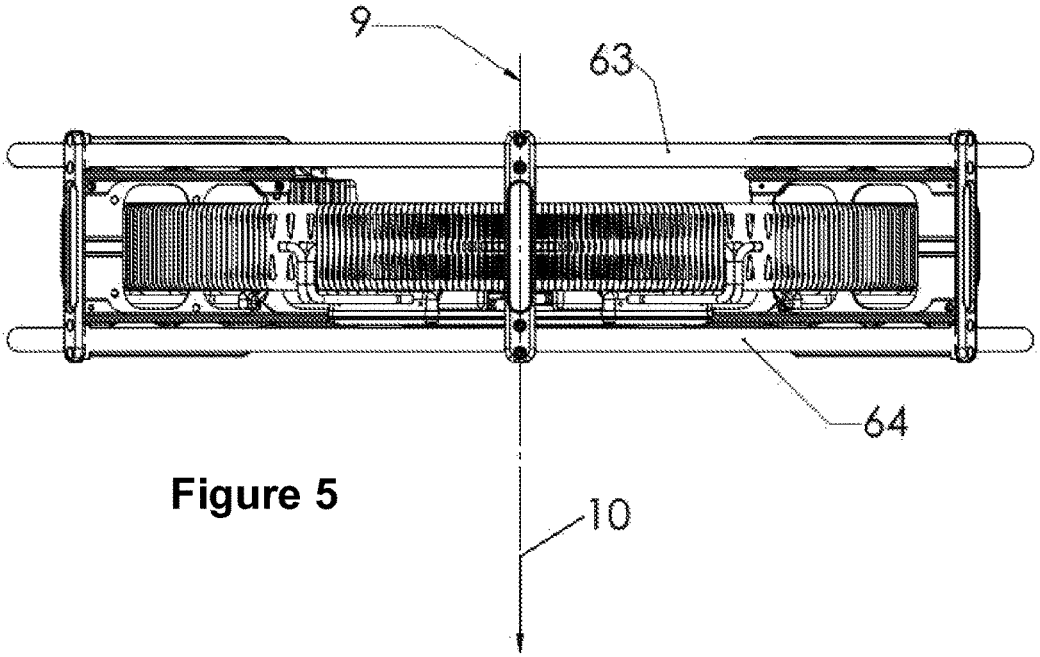
FIG. 5 is a front view of the system of FIG. 1.
Figure 4:
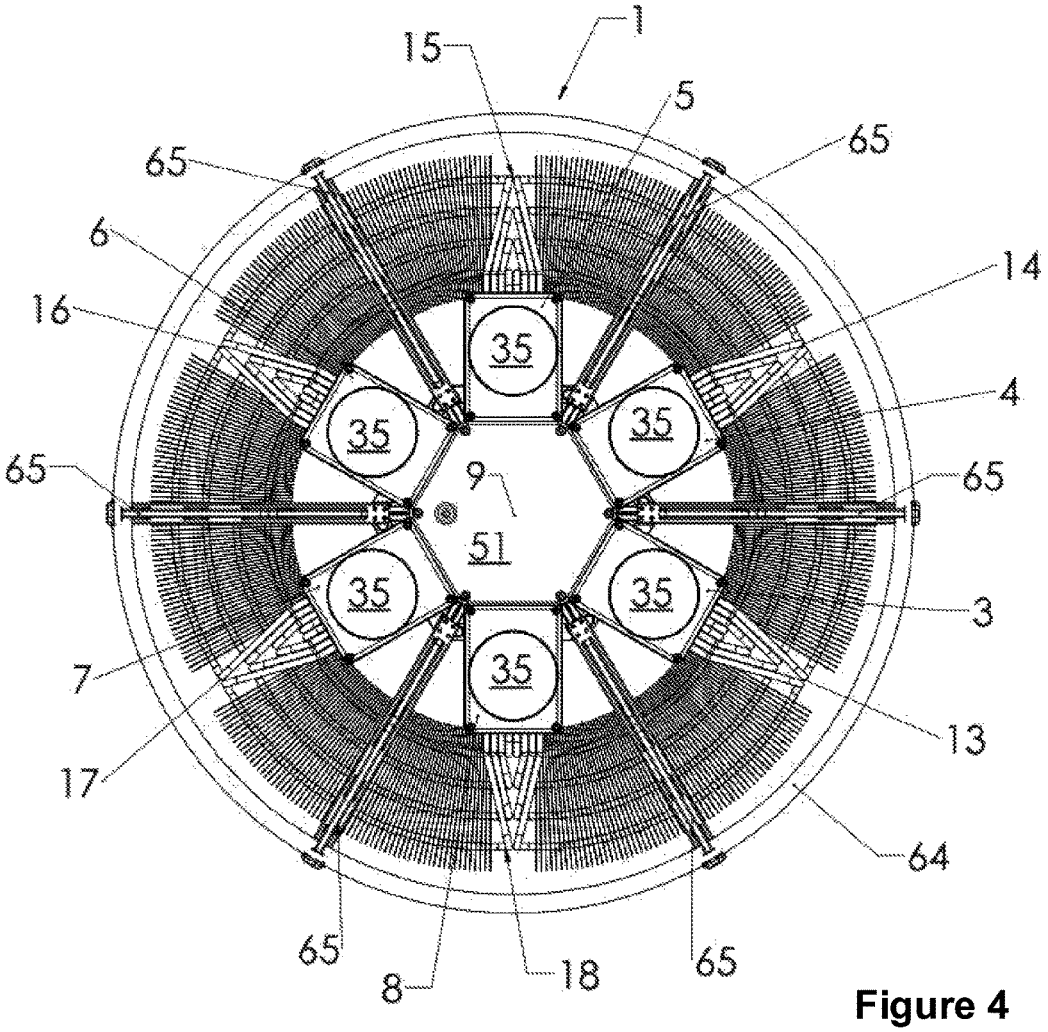
FIG. 4 is a bottom view of the system of FIG. 1.
Figure 11:
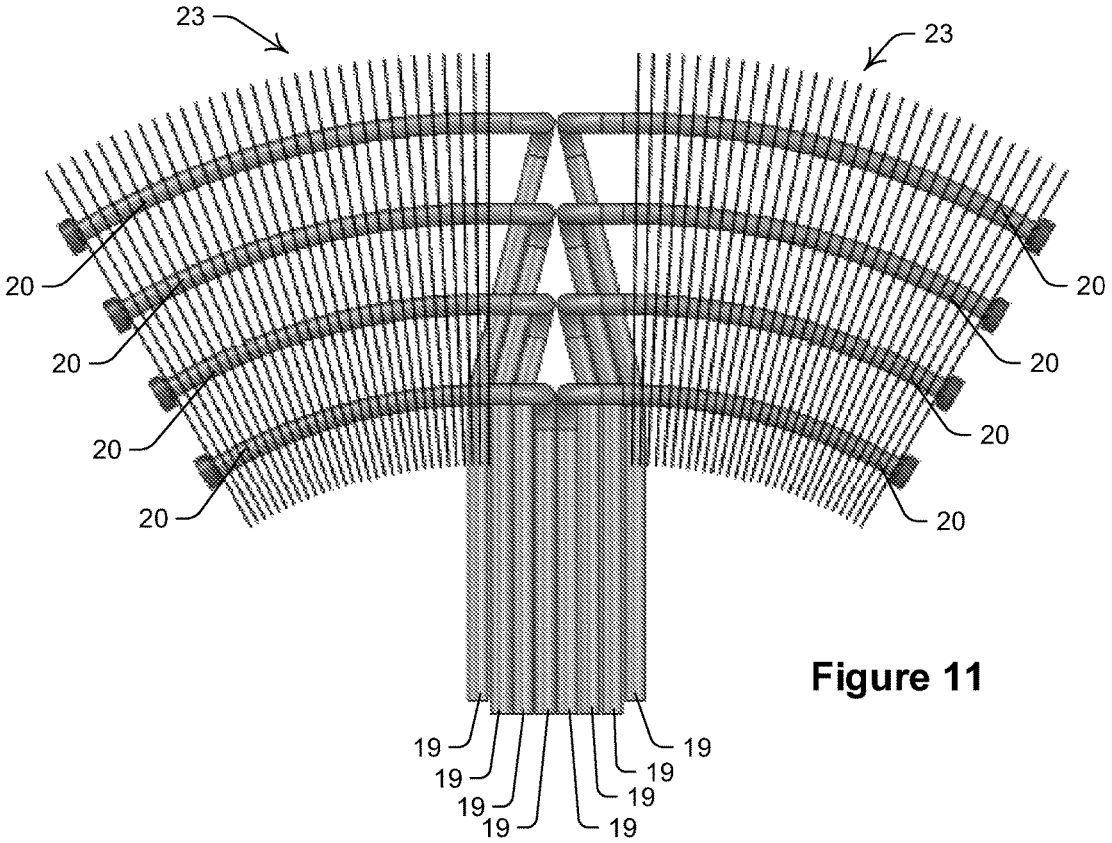
FIG. 11 is a plan view of the array of heatpipes and the array of heat exchange elements used in the module of FIG. 6.

Referring to FIGS. 1 to 6 there is illustrated a lighting system 1 that includes six equally circumferentially spaced apart and radially diverging light modules 3, 4, 5, 6, 7 and 8 for emitting light. The modules are disposed closely adjacent to each other and the light collectively defines a beam of light (not shown) that is directed along a primary axis 9 in a first axial direction 10. As best shown in FIG. 4, a plurality of heat conductors, in the form of six like sets 13, 14, 15, 16, 17 and 18 of heatpipes, allow heat to be drawn away from respective modules 3, 4, 5, 6, 7 and 8. As best shown in FIGS. 11 to 14, each set of heatpipes includes eight separate continuous heatpipes, and as best shown in FIG. 11, each heatpipe in each set includes a first end 19 that is thermally connected to the relevant module and a second end 20 that is radially spaced apart from the first end 19. Six heat exchange elements, in the form of six respective like segmented arrays 23, 24, 25, 26, 27 and 28 of radially diverting heat exchange fins, are radially spaced apart from the modules and are thermally connected with the second ends 20 of the heatpipes in the relevant sets for allowing the heat to be dissipated from those heatpipes. Moreover, in this embodiment, the arrays 23, 24, 25, 26, 27 and 28 of heat exchange fins extend radially away from the respective modules 3, 4, 5, 6, 7 and 8.

Figure 6:
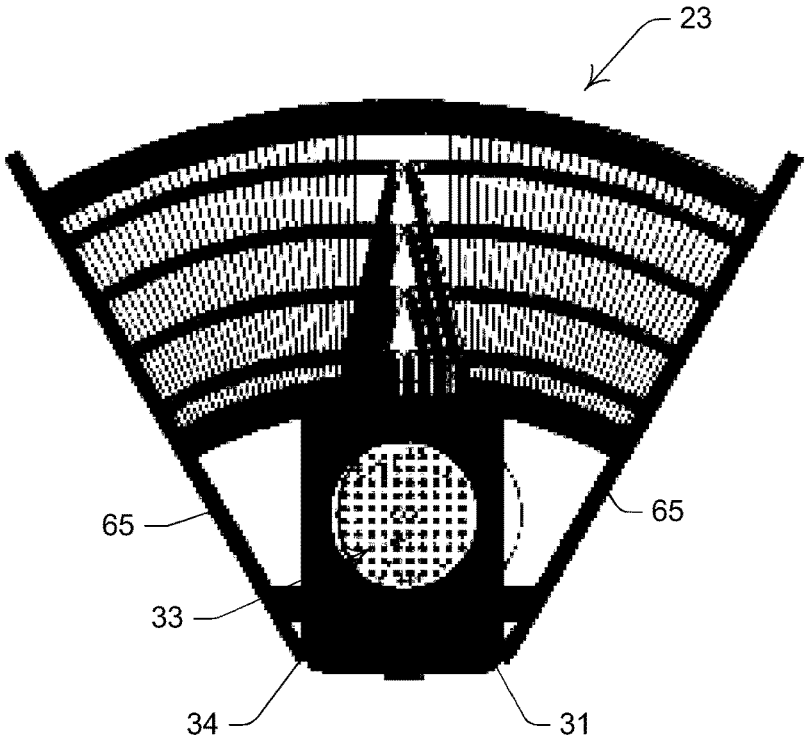
FIG. 6 is a bottom view of one of the six lighting modules used in the system of FIG. 1 including the reinforcing spokes of a mounting system.
Figure 7:
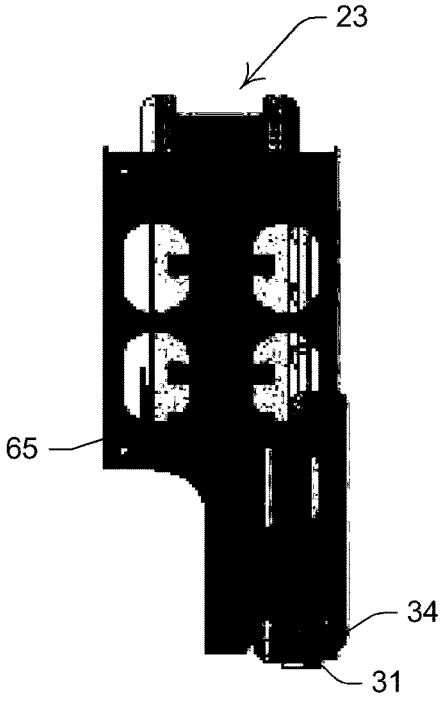
FIG. 7 is a side view of the lighting module of FIG. 6.
Figure 10:
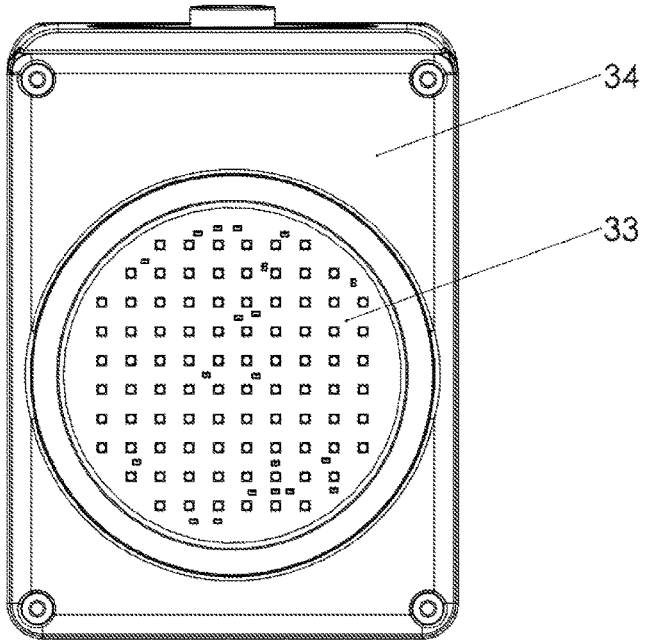
FIG. 10 is a bottom view of an LED array used in the module of FIG. 6.
Figure 14:
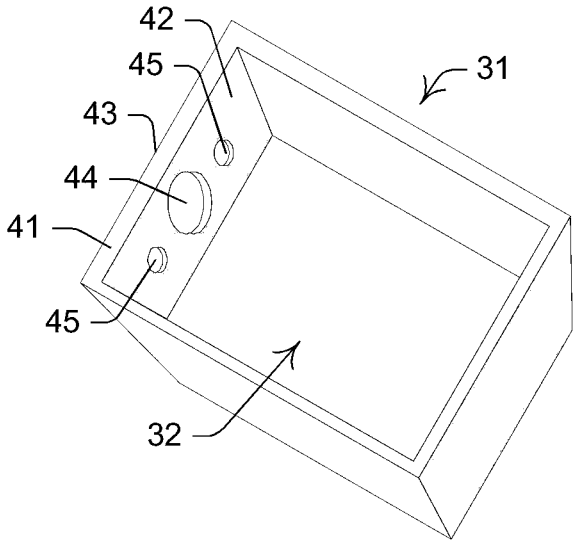
FIG. 14 is a bottom perspective view of a housing of the module of FIG. 6 with the base plate and the electrical equipment removed.

The six modules 3, 4, 5, 6, 7 and 8 each include a generally rectangular prismatic housing 31, which is illustrated specifically in FIG. 14, for defining an internal cavity 32 in which is disposed an LED array 33 (see FIGS. 6 and 10) and associated electrical equipment. As shown in FIGS. 6 and 10 particularly, housing 31 also includes a lower face 34 having a generally circular window 35 through which light from array 33 is emitted. In use, windows 35 of modules 3, 4, 5, 6, 7 and 8 are covered by respective substantially transparent and robust lenses 36 and extend substantially along a common plane that is normal to axis 9.

In this embodiment, each array 33 includes 80 LEDs. However, in other embodiments different numbers of LEDs are used. It will also be appreciated that diametrically opposed modules include like arrays of LEDs, in that the LEDs in those arrays emit light of substantially the same wavelength. Moreover, each of the three pairs of diametrically opposed modules include arrays of LEDs that emit respective different wavelengths, being red, green and blue respectively. The light from the arrays mixes to form the beam. The intensity of each diametrically opposed pair is suitably controlled by other components of system 1 (not explicitly shown) to allow the colour and intensity of the beam to be consequently controlled.

This embodiment includes an even number of light modules to simplify the control function to obtain the desired colour and intensity of the beam. For the same reason, in this embodiment the like modules—that being modules having LEDs that emit substantially the same wavelength of light—are diametrically opposed. In other embodiments a different number of modules are used, and in some such embodiments this includes an odd number of modules. In still further embodiments, like modules are used, although they are other than diametrically opposed.

While in this embodiment use is made of LEDs in different modules emitting different wavelengths of light, in other embodiments all modules emit light of substantially the same wavelength (that is, of substantially the same colour).

The modules are arranged in a uniform radially divergent array such that each module in the array is immediately adjacent to at least two other modules and closely adjacent to all the modules. This ensures that windows 35 are also closely adjacent to allow the light emanating from those windows to more effectively mix to form the beam of light and to allow for ease of control of the LEDs to more effectively and accurately achieve different colour combinations for the beam.

In other embodiments different array formations are used for the modules, such as a linear array, a square array, a rectangular array, a generally circular array, or other arrays.

The arrays 23, 24, 25, 26, 27 and 28 of heat exchange fins are axially offset from the modules 3, 4, 5, 6, 7 and 8 in a second direction that is opposite to the first direction 10. This allows for a small radial overlap between the array of fins and the respective adjacent modules to optimise the available passive cooling capacity offered by the arrays of fins within the radial footprint of system 1. In other embodiments the array of fins is entirely radially offset from the adjacent modules: that is, there is no radial overlap of the arrays and modules to maximise the cooling effect of the arrays. In other embodiments, however, the arrays overlap the modules significantly to reduce the radial footprint of the lighting system.

Figure 9:
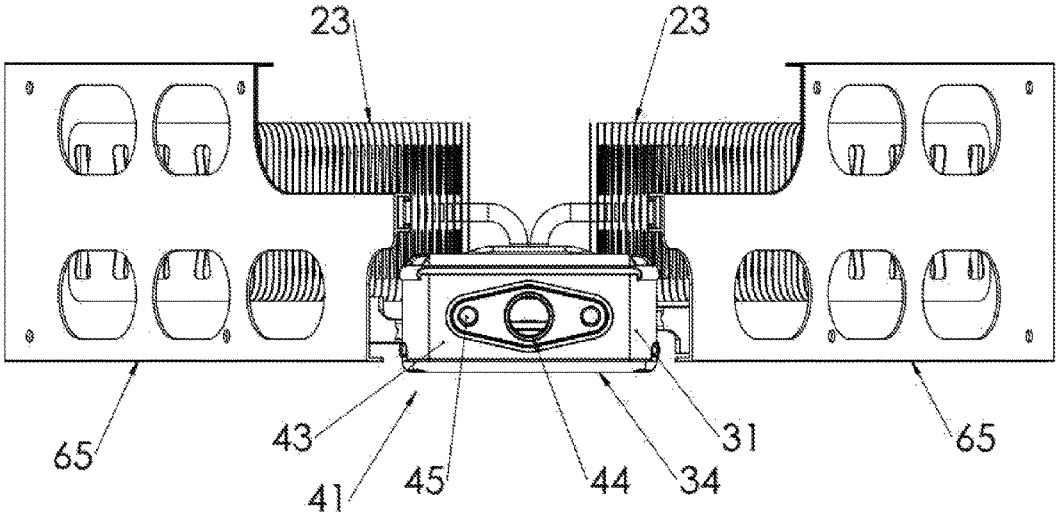
FIG. 9 is a front view of the lighting module of FIG. 6.

As best shown in FIGS. 9 and 14, housing 31 includes a radially inner end wall 41 that is generally rectangular and includes an inner face 42 for defining in part cavity 32, and an opposite outer engagement face 43 that is, in use, the most radially inwardly disposed part of housing 31. Wall 41 includes a centrally located generally circular aperture 44 that extends fully between faces 42 and 43 for selectively receiving one or more pieces of electrical equipment. Typically, in use, the electrical equipment that is received within aperture 43 is one or more electrical cables that extend between other pieces of electrical equipment disposed within cavity 32 and external to cavity 32.

Wall 41 also includes two like spaced apart apertures 45 that flank aperture 45 and which are centred upon a common line with that aperture. As will be described further below, apertures 45 are configured to cooperate with fastening devices such as bolts, screws or other such fasteners to securely removably mount housing 31 to a hub (which is described further below).

As best shown in FIG. 9, wall 41 includes a sealing face 47 that extends about all of apertures 44 and 45. This sealing face, in this embodiment, is formed from a rubber-based material that is fixedly applied to face 43 of wall 41. In other embodiments use is made of a silicon-based coating, a ceramic based coating, or a more conventional washer. Preferentially, the sealing face is integral with or fixedly attached to face 43.

System 1 includes a centrally disposed mounting hub 51 for connecting to each of the modules 3, 4, 5, 6, 7 and 8. As illustrated, the modules extend radially outwardly from the hub and radially away from each other. Moreover, in this embodiment, the modules are equally circumferentially spaced about the hub and their bases extend along a common plane. Hub 51 includes a generally hexagonal prismatic hub housing 52 for defining therein a correspondingly hexagonal prismatic hub cavity (not shown). Housing 52 also includes an outer face that is segmented into six portions corresponding to the six sides of the hexagonal prism defined by housing 52. Each of those six portions include three hub apertures that correspond in size and relative location with apertures 44 and 45 respectively such that, when the six separate faces 41 of the modules are engaged with respective portions of housing 52 the apertures in the adjacent housings align. This allows fastening devices to be used to releasably and individually secure the modules to housing 52, and for electrical equipment, such as electrical cabling, to extend through the larger central apertures. Accordingly, the electrical cabling is able to connect other electrical equipment that is disposed within the cavity defined by housing 52 and the cavities 32. In other embodiments, the electrical cabling extends between modules, via hub 51. Moreover, due to the operation of face 47, modules 3, 4, 5, 6, 7 and 8 are sealingly engaged with housing 52.

It will be appreciated that modules 3, 4, 5, 6, 7 and 8 are releasably mounted to hub 51 to allow for their individual replacement. This facilitates repair of system 1, and also reduces the cost of that repair as there is only a need to replace the inoperable or damaged component or components and not the entire lighting or cooling system. The modular nature inherent in the modules also simplifies the type and number of spare parts that need to be carried to support repairs. In overall terms this reduces downtime and reduces operating costs.

In other embodiments at least one of modules 3, 4, 5, 6, 7 and 8 are integrally formed with hub 51. In further embodiments, all of modules 3, 4, 5, 6, 7 and 8 are integrally formed with hub 51. In such embodiments, end wall 41 of the integrally formed modules is omitted, and the cavity 32 is a continuous extension of the cavity provided by hub 51.

Where a module is integrally formed with hub 51 the array of heatpipes for that module is preferentially releasably mounted to the module. Accordingly, should any of the fins in the arrays be damaged during transportation or use, it is relatively easy to have the affected array removed and replaced without having to replace all the arrays.

System 1 includes a mounting formation, in the form of a mounting frame 61, for allowing mounting of system 1 to another object such as a stand, a gantry, a scaffold, a frame member, or other support member. Frame 61 includes two generally circular axially spaced apart circumferentially extending aluminium members 63 and 64 and six aluminium reinforcing spokes 65 (as best shown in FIG. 2) that are connected at their radial outer ends to the circumferential members 63 and 64. Those members lie radially and axially outwardly of the arrays 23, 24, 25, 26, 27 and 28 of heat exchange fins and provide physical protection for those fins against mechanical stresses and damage without compromising the cooling capacity of those arrays.

Figure 8:
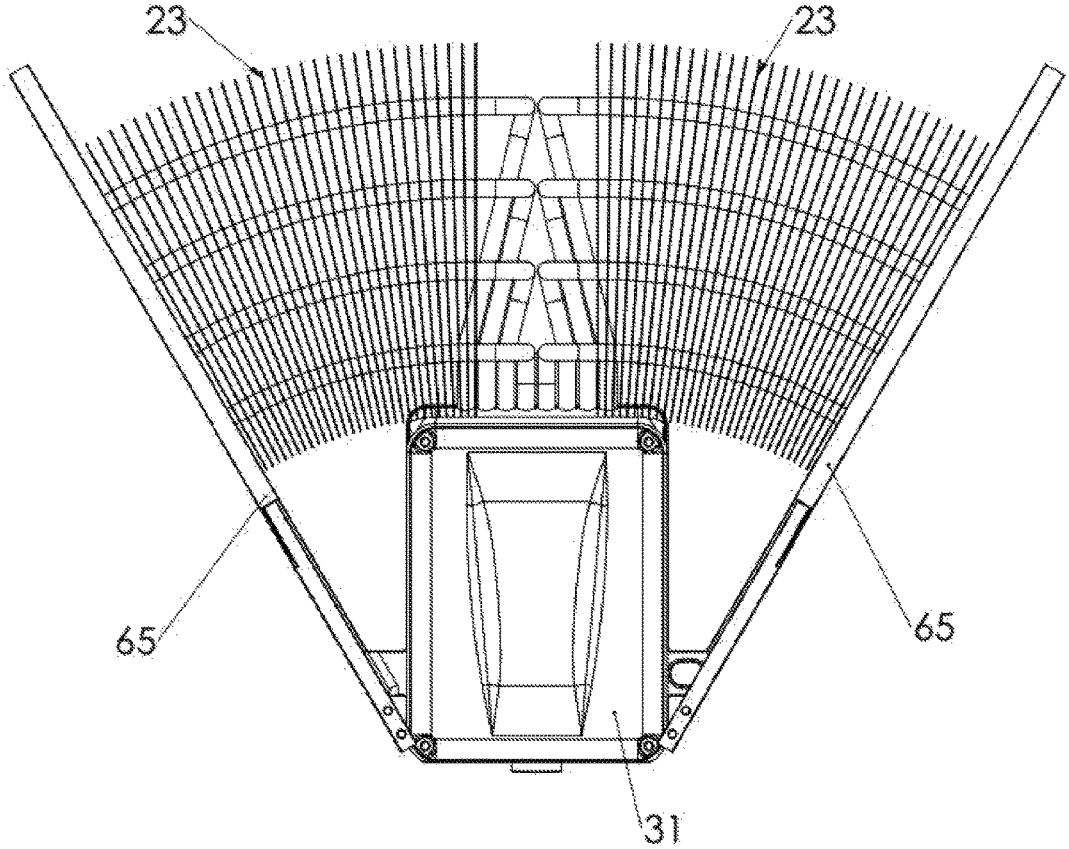
FIG. 8 is a plan view of the lighting module of FIG. 6.

Spokes 65 extend radially inwardly from members 63 and 64 and terminate at radial inner ends that are releasably secured to hub 51. As best shown in FIGS. 8 to 10, each of spokes 65 are formed from respective rigid aluminium beams with web openings to facilitate the movement of air, and all the spokes extend axially and radially beyond arrays 23, 24, 25, 26, 27 and 28 to provide further physical protection for those arrays.

In other embodiments only a subset of the spokes extends axially in both directions beyond the arrays. In further embodiments, a subset of spokes extends axially in one direction beyond the arrays, and the remainder of the spokes extend axially beyond the arrays in the other axial direction.

The spokes are releasably attached both to hub 51 and members 63 and 64. This allows for ease of partial disassembly of frame 61 to access any one or more of modules 3, 4, 5, 6, 7 and 8 and arrays 23, 24, 25, 26, 27 and 28. That is, any one or more of those modules or arrays are able to be easily accessed and removed, as required, without having to necessarily access or remove any other components. This facilitate repair of system 1, reducing downtime, and reducing running costs due to only having to replace the require component and not other components also.

Hub 51 includes three equally circumferentially spaced apart metal engagement pins 71 that extend from within housing 52 and upwardly to selectively engage with corresponding locking formations (not shown). Those locking formations are provided on a support structure (not shown) for allowing selective locking attachment of system 1 to the support structure. In some embodiments the support structure is a power supply, and pins 71 are conductive for electrically connecting the power supply to the electrical equipment in hub 51 and/or the adjacent modules. In other embodiments a different number of pins are used.

System 1 includes a colour mixing system (not shown) contained within module 3 for calculating estimated colour coordinates and for controlling a user interface display (on the top face of module 3). The display provides visual feedback to a user using standard industry terms such as CCT (Colour Temperature), intensity, Hue/Saturation and the like. In this embodiment use is made of high power led arrays utilising at least 3 LED colours (which in this embodiment includes red, green and blue) and additionally white.

The fins in arrays 23, 24, 25, 26, 27 and 28 are arranged in a radially divergent format, and are each formed from punched sheet aluminium. The fins include punched apertures for facilitating the movement of air about the fins to increase the cooling capacity offered by the array.

The combination of the large number of thin fins and the concentric heatpipe arrangement keeps the weight of system 1 low, and yet provides for a high thermal load capacity for a passively cooled system. This thermal design enables the use of high power LED arrays and therefore high thermal density and obviates the need for fans. This allows for a near-silent operation of system 1, which is particularly advantageous in a studio environment. In embodiments where the use of fans is acceptable—for example, for still photography and other situations where audio quality is unimportant or less important—these are able to be combined with system 1 to allow even higher power outputs.

The mounting frame 61 is also formed from aluminium and is lightweight and yet robust and protective of the relatively sensitive heatpipes and arrays of fins disposed within the frame. In other embodiments the frame, or one or more of the frame elements, are formed from a material other than aluminium. For example, in some embodiments, use is made of high strength plastics, or other lightweight materials having a high tensile and compressive strength.

System 1 is able to mate with a complementary power supply (not shown) via pins 71. In some embodiments, the power supply provides DC power. However, in other embodiments the power supply provides AC power and an additional transformer is required. The power supply preferentially includes a sealed housing so that system 1 and the power supply are suitable for use in a wet and/or humid environment.

The use of pins 71, or like formations, allows the power supply to lockingly attach and detach from system 1. This allows for mass reduction—that is, installation and removal are more easily undertaken by separating the two relatively heavy items from each other—as well as accommodating many different rigging options. For example, the power supply is able to be rigged where convenient, such as near a mains power outlet. System 1 is then able to be rigged directly onto the power supply or, if another location is more suitable, at that other location, and an electrical lead is then used to connect system 1 to the power source.

Pins 71 provide part of an attachment or mounting system for system 1. The functions of this attachment system are to provide: robust mechanical load bearing of the components; and an integrated safety mechanism to ensure safe operation and ease of attachment and detachment.

It will be appreciated by those skilled in the art that the modules contain a variety of electrical equipment, including an integrated LED board and the LED drive electronics which are critical for the correct operation of the high power LED arrays used.

The radial inner ends 19 of the heatpipes are disposed within the relevant cavity 32 and thermally engaged with one or more pieces of electrical equipment that is contained within that cavity. Such electrical equipment includes one or more circuit boards, such as a board for the control and driver circuitry for the associated array of LEDs, and a board to which the LEDs are mounted. This allows the heatpipes to rapidly convey the heat generated by the components on these boards radially outwardly to ends 20. This heat is transferred to the fins and radiated passively to the surrounding air.

Figure 12:
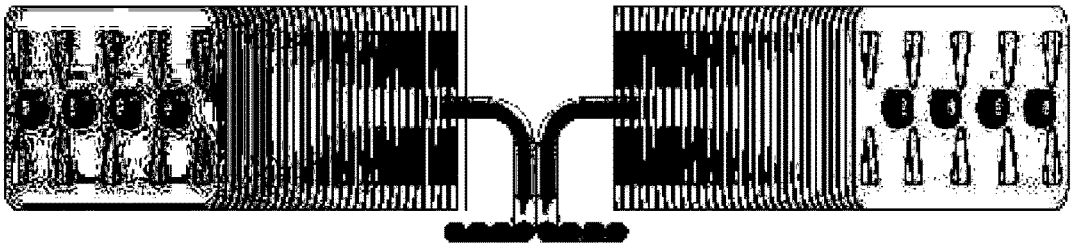
FIG. 12 is a front view of the arrays of FIG. 10.
Figure 13:
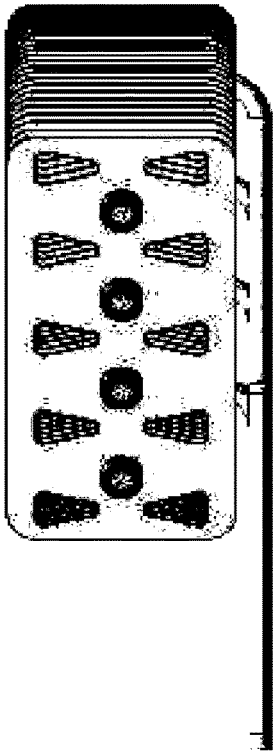
FIG. 13 is a side view of the arrays of FIG. 10.

As best illustrated in FIGS. 11 to 13, the eight heatpipes in each array extend from ends 19 substantially radially and then, intermediate ends 19 and 20, bend to extend generally circumferentially. Four of the heatpipes in the array extend circumferentially in one direction, although equally radially spaced apart from each other, while the remaining four extend circumferentially in the opposite direction, also equally radially spaced apart from each other. Each of the fins is thermally connected with four of the heatpipes adjacent to ends 20. In other embodiments different shaped and configuration of heatpipes are used within one or more of the arrays.

The embodiment illustrated in the figures weighs about 23 kg and consumes about 1,200 Watts when operating at full power. Accordingly, there is provided a lightweight space light which high power output, which allows for broad application. Moreover, relative to the prior art, for a given light output there is either a power saving, or a need to use a lesser number of the lighting systems.

System 1 provides IP65 (although this is due to the use of a DMX control connector assembly). In other embodiments, different levels of performance are achieved. Moreover, system 1 produces a typical CRI of 94 across the range from 3200° K to 10,000° K.

Figure 15:
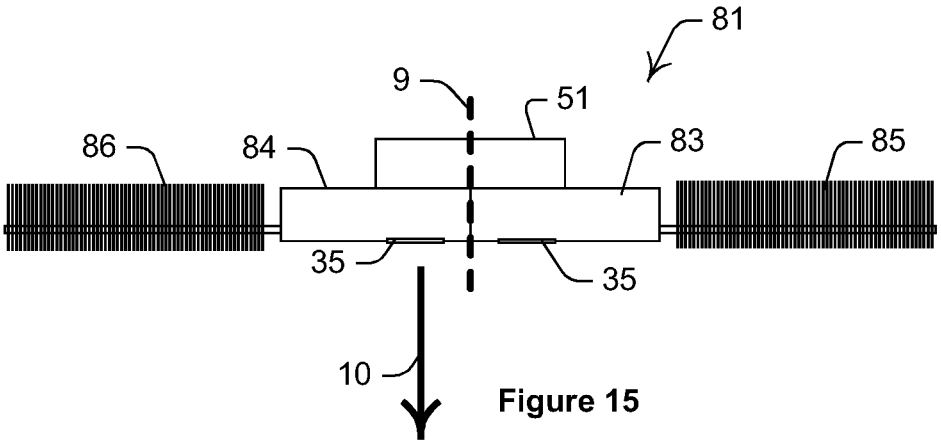
FIG. 15 is a side view of a lighting system according of another embodiment, sans a mounting frame.
Figure 16:
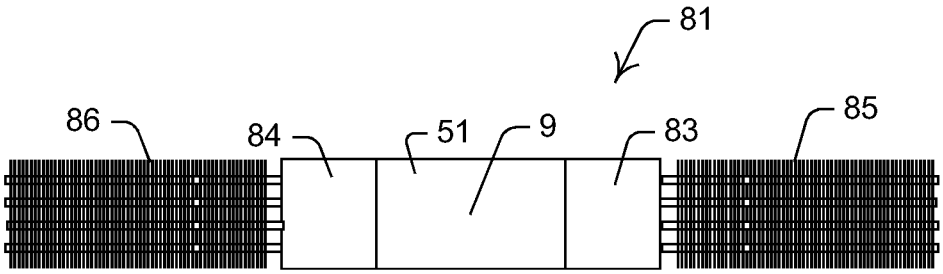
FIG. 16 is a top view of the system of FIG. 15.

Reference is now made to FIGS. 15 and 16 where this is illustrated a further embodiment of a lighting system 81. It will be appreciated that corresponding features are denoted by corresponding reference numerals. In particular, system 81 includes two generally rectangular prismatic modules 83 and 84 that disposed side-by-side and each sealingly engaged with the underside of a generally rectangular prismatic hub 51 such that electrical equipment is able to extend between the hub and the modules. The modules include respective windows 35 from which light emerges to form a single beam (not shown) that has a beam axis 9. The width of the modules and the hub are substantially identical. Arrays 85 and 86 of fins extend outwardly from the respective modules 83 and 84 in opposite directions.

Figure 17:
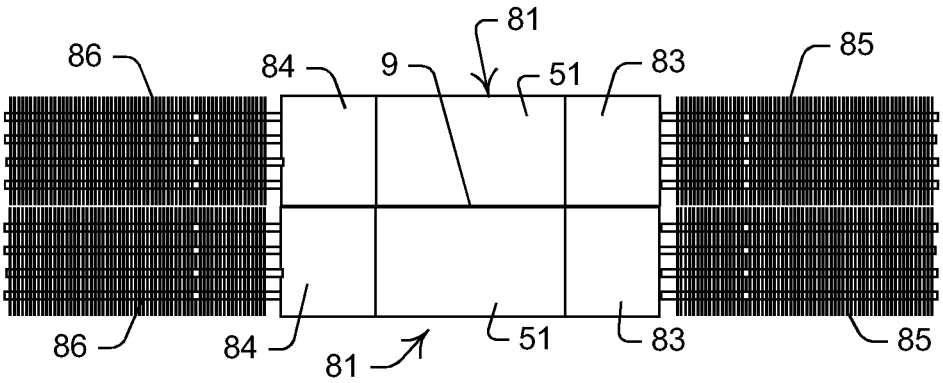
FIG. 17 is a top view of two like systems of FIG. 15 connected as a combined lighting system.

A plurality of systems 81 is able to be combined to define a larger array of lights. For example, in FIG. 17 there is illustrated two like systems 81 that are releasably engaged with each other in a coextensive side-by-side relationship. The combined lighting system provides a 2×2 array of LEDs and the axis 9 of the resultant beam is differently position than was the case for the 2×1 array of LEDs provided by system 81 of FIG. 16.

It will be appreciated that one or more additional systems 81 are able to be added to extend the array to a 2×N array. For practical purposes, N is typically no more than about 12. However, other embodiments are specifically disposed to allow larger arrays.

Figure 18:
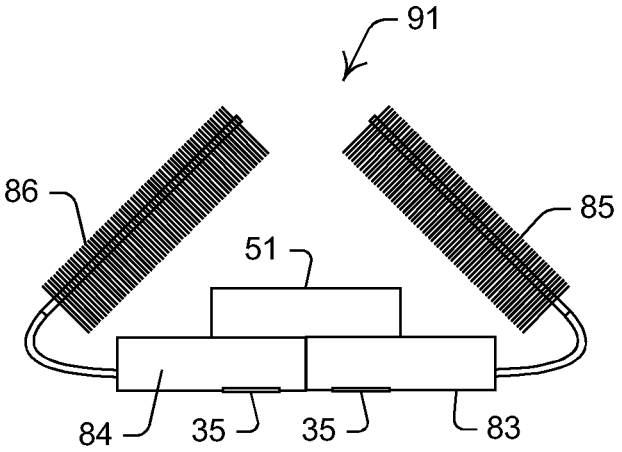
FIG. 18 is a lighting system according to a further embodiment, sans a mounting frame.
Figure 19:
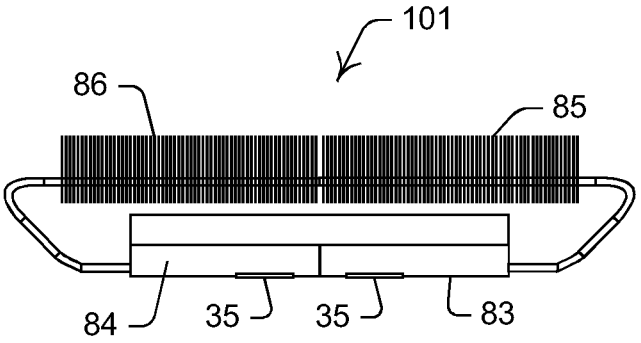
FIG. 19 is a lighting system according to a still further embodiment, sans a mounting frame.

Reference is now made to FIG. 18 where another embodiment is illustrated in the form of system 91. Particularly, system 91 is similar to system 81 although arrays 85 and 86 extend upwardly and inwardly from the outer edges of respective modules 83 and 84. A further embodiment is illustrated in FIG. 19, where a system 101 includes arrays 85 and 86 that are disposed above and extend substantially parallel to respective modules 83 and 84.

The use of heatpipes in the above lighting systems provides additional flexibility in packaging the heat exchange elements. This allows the use of larger heat exchange elements that are able to accommodate higher power LED arrays and hence provide greater lighting capability while still relying upon passive cooling. It also has the advantage of allowing the LED arrays to be more closely disposed relative to each other to improve the formation of the beam of light provided by the lighting system. The latter is particularly important in those embodiments making use of LED arrays that provide different coloured light to form the beam.

Figure 20:
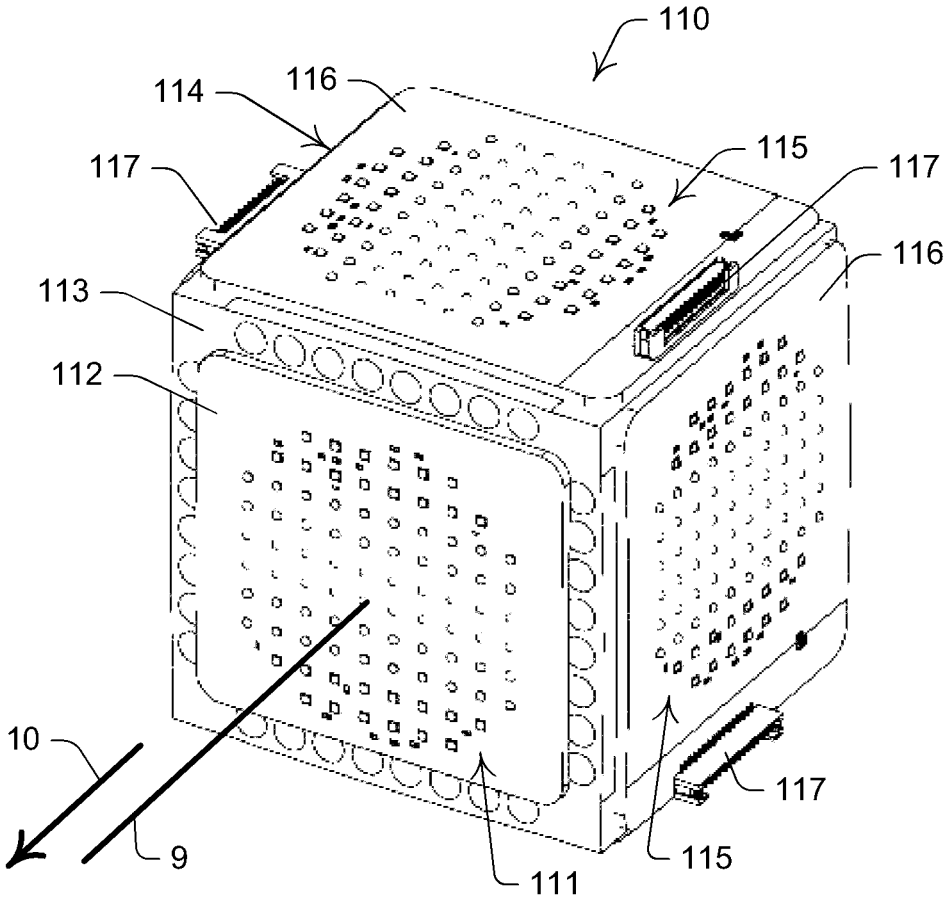
FIG. 20 is a perspective view of an LED array used in another embodiment of the invention

In the embodiments described above, each module includes an array 33 of LEDs that extends along a single plane. The associated drive circuitry is mounted behind the array and in close proximity to one end of the heat pipes. In other embodiments, each array of LEDs is segmented and extends along a plurality of planes. An example of such an array of LEDs is illustrated in FIG. 20, where corresponding features are denoted with corresponding reference numerals. More particularly, there is shown an array 110 of LEDs that includes five like array segments arranged to extend along five respective planes. A first of these segments, segment 111, in use, extends along a generally horizontal plane like the arrays 33 in the above embodiments. Segment 111 is generally circular and lies in a single plane. This segment is mounted to a generally square LED circuit board 112 that, in turn, is mounted to a first face 113 of a five faced generally cubic housing 114. The four further like LED segments 115 (only two of which are explicitly shown in FIG. 20 for the other two are obscured) are mounted to respective LED circuit boards 116 which, in turn, are mounted respectively to the four faces of housing 114 that extend away from and collectively surround face 113. It will be appreciated that array 110, in use, is nested within a surrounding reflector (not shown) to redirect the light emitted by the four segments 115 along axis 9 in direction 10. In this embodiment, housing 114 includes ports 117 for receiving control signals for controlling the circuitry (not shown) that drives the LEDs in array 110.

Figure 21:
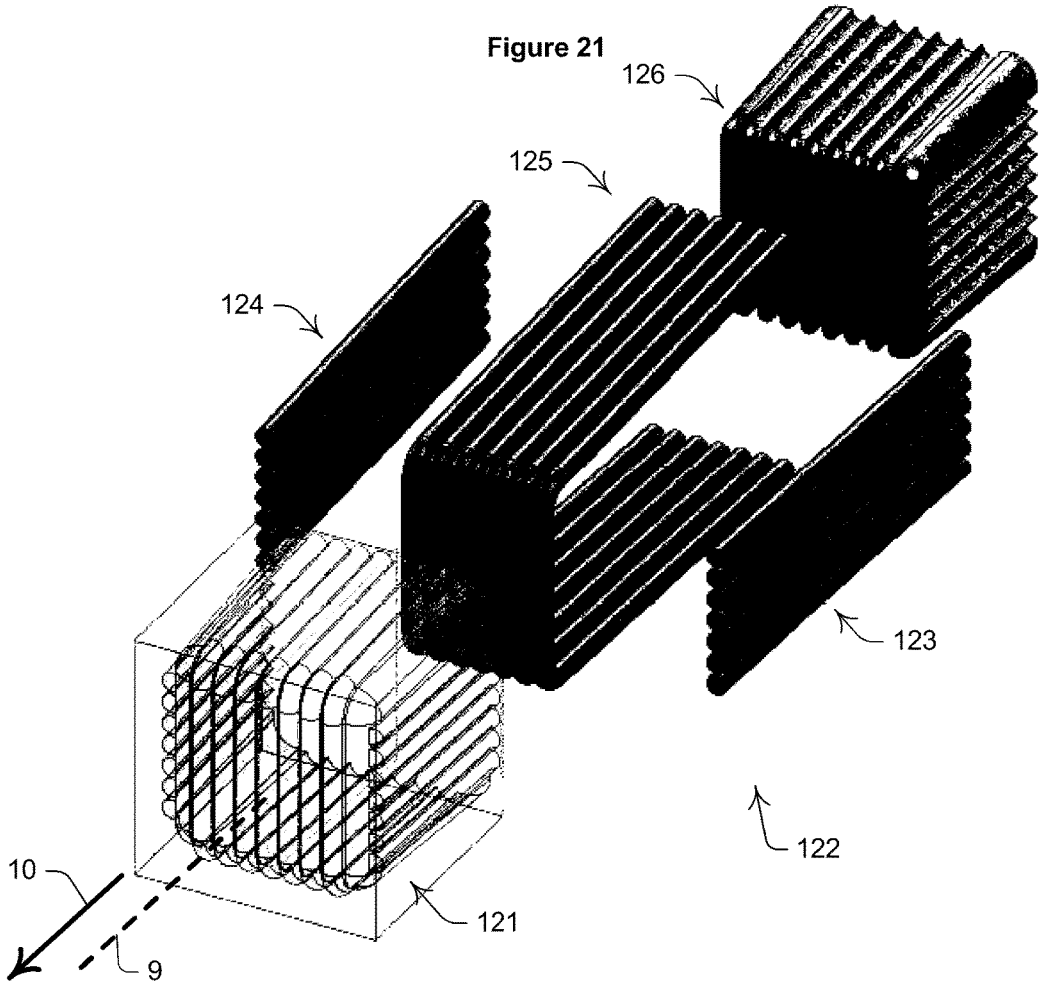
FIG. 21 is an exploded perspective view of a heatpipe array for a multi-planar array of LEDs
Figure 22:
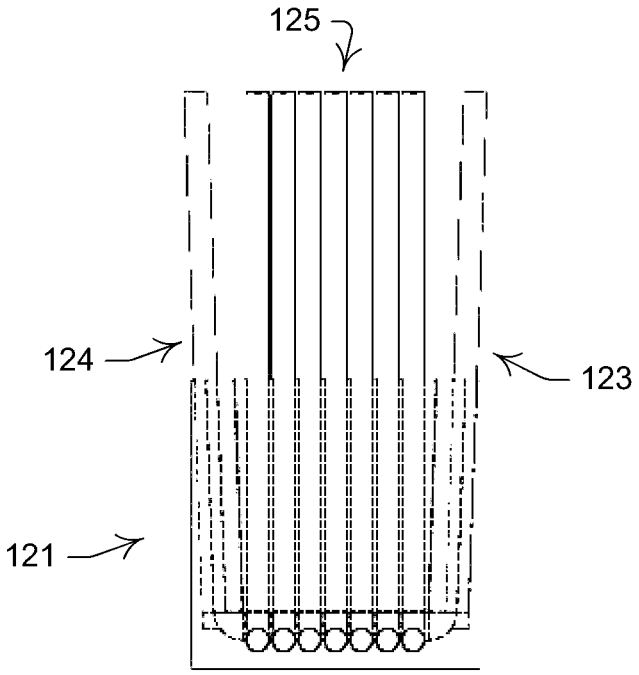
FIG. 22 is a side view of the assembled array of FIG. 21 showing hidden detail for the heatpipes.
Figure 23:
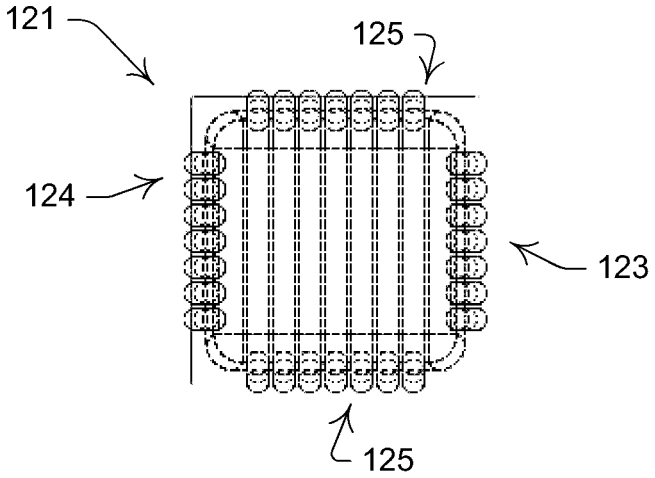
FIG. 23 is an underside view of the array of FIG. 22.
Figure 24:
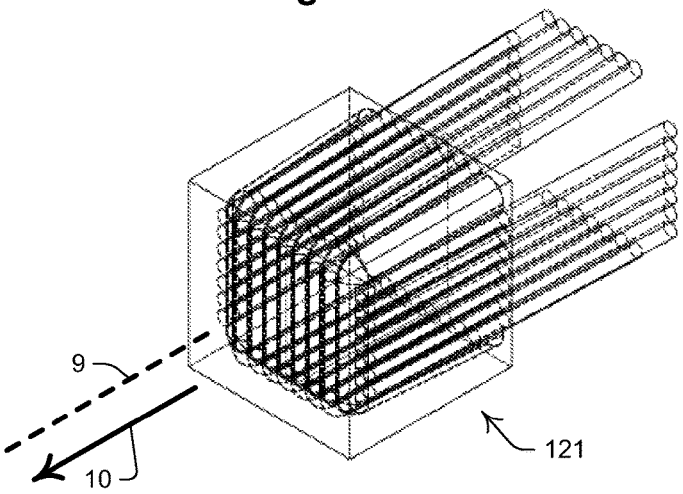
FIG. 24 is a perspective view of the array of FIG. 22.
Figure 25:
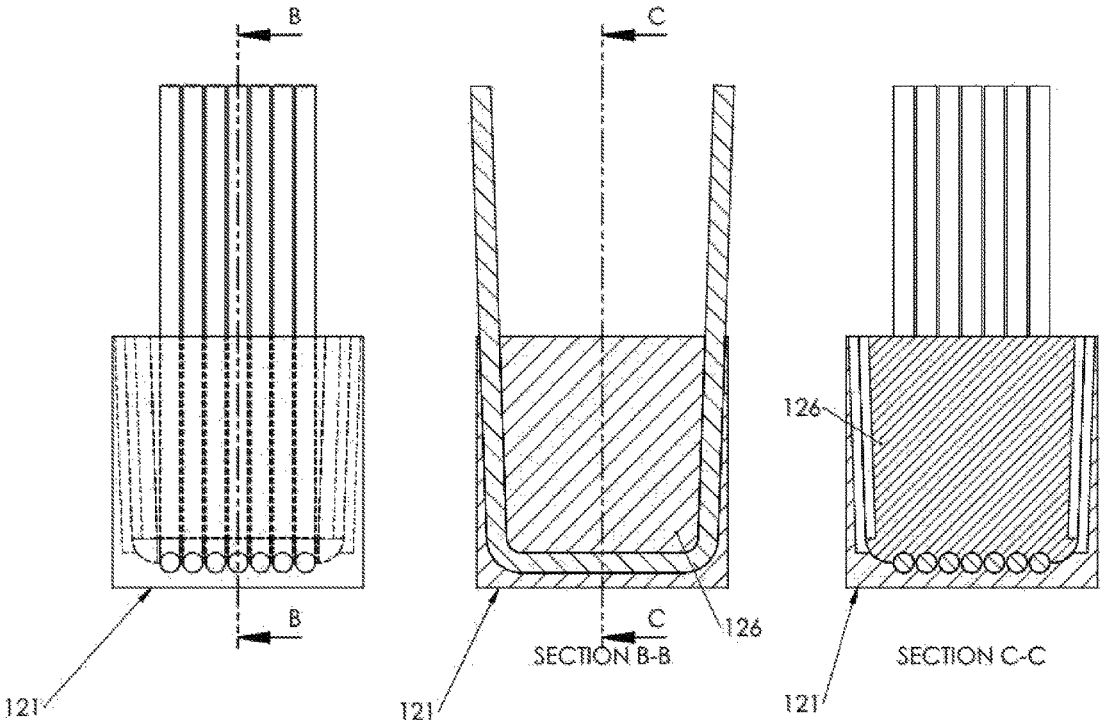
FIG. 25 includes a side view of the array of assembled array of FIG. 21 without showing the hidden detail, together with two sectional views of the assembled array.

Housing 114 includes an array of heatpipes (not shown) that extend behind boards 116 and which end in face 113. This array 120 also includes a bowed set of heatpipes (not shown) that extend under array 111 within housing 114. It will be appreciated, given the benefit of the teaching herein, that many other heatpipe configurations are possible. By way of example, a further five faced generally cubic housing 121 is illustrated in FIG. 21. Housing 121 includes internal formations for closely complementarily receiving the individual heatpipes in an array 122 of heatpipes. This close physical conformity, together with any additional intermediate thermally conductive adhesive or other suitable bonding material, facilitates good heat transfer to the heatpipes from the array of LEDs and the circuitry driving that array. Array 122 has a first generally linear sub-array 123 of heatpipes that extends behind one face of housing 121, and a second generally linear sub-array 124 of heat pipes that extends behind an opposite face of housing 121. A third sub-array 125 of heatpipes is formed in a bowed or a tapered U-shape that extends behind two further opposed faces of housing 121, and along the remaining face. A tapered inner core 126 is inserted into housing 121 and complementarily engages with all the heatpipes in the array 122. This configuration allows for heat to be removed from all five LED arrays notwithstanding the multi-planar nature of those arrays. Moreover, the heatpipes are inclined or tapered with respect to the four vertical faces of housing 121 to facilitate both assembly and a tight thermal fit between the components. That is, as the individual heatpipes extend from housing 121 they continue their outward incline from the heatpipes in the other sub-arrays.

It will be appreciated that in other embodiments where use is made of loop heatpipes (LHP) or fluid cooling, that the heatpipes in sub-arrays 123 and 124 are configured to loop back along their length.

In FIG. 21 use has been made of seven uniform and like heat pipes in each sub-array of heat pipes. In other embodiments a different numbers of heatpipes are used in any one or more of the sub-arrays of heatpipes. As few as one heatpipe is possible, so long as it is formed to allow heat removal from all sub-arrays of LEDs. In other embodiments, however, use is made of more than seven heatpipes in one or more of the sub-arrays of heat pipes.

The manufacture of array 122 includes the initial placement of the heatpipes in the sub-arrays in the complementary formations in core 126. The heatpipes are in some embodiments coated in solder, or a heat conductive adhesive to facilitate a good thermal connection between those heatpipes and core 126. This formed core and heatpipes, which define a tapered head, is inserted into the opening in housing 121 and wedged in that housing in an interference fit. The internal surface of housing 121 is also tapered and includes formations for complementarily receiving the adjacent heatpipes.

In other embodiments housing 121 is other than generally cubic. For example, in one such embodiment, the housing (not shown) forms a rectangular prism—that is, not all faces have the same dimensions—where the downwardly directed face is generally square and the four vertical faces are elongate and contain a greater number of LEDs in the respective sub-arrays than the square face. In other embodiments the housing supports more than five sub-arrays. For example, in one embodiment, the housing includes eleven like faces that extend along respective planes and which each support respective sub-arrays of LEDs. In other embodiments different numbers of faces are used.

Figure 26:
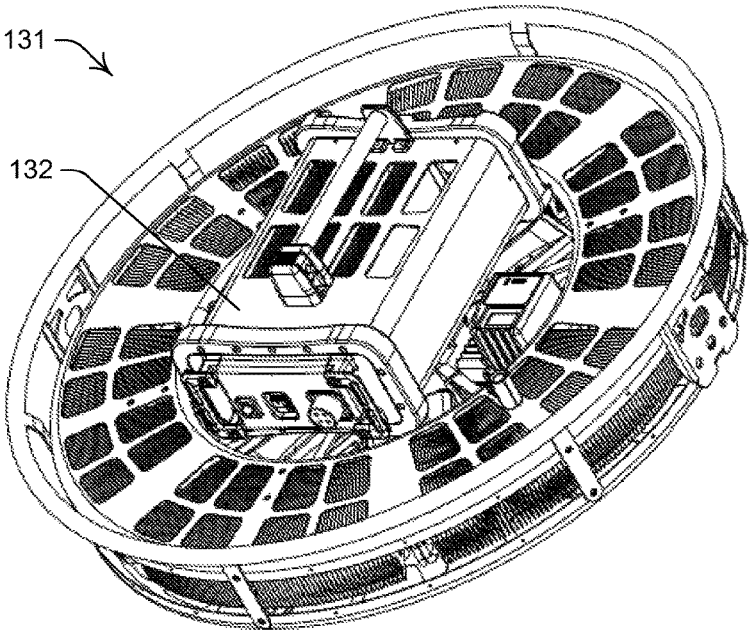
FIG. 26 is a top perspective view of a space light system according to another embodiment of the invention including a top mounted power supply.
Figure 27:
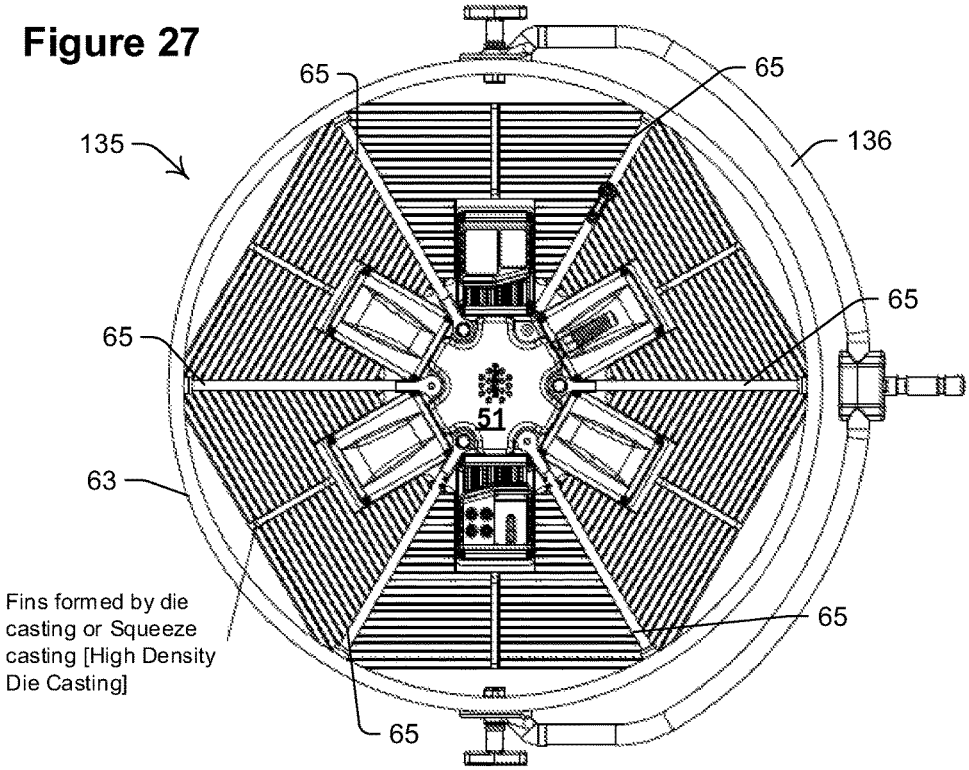
FIG. 27 is a top view of a space light system according to another embodiment of the invention including generally circumferentially arranged cooling fins.

A further embodiment of a space light system using radial cooling fins is illustrated in FIG. 26, where corresponding features are denoted by corresponding reference numerals. More particularly, the space light system 131 is shown with a top mount power supply 132 securely and releasably attached via pins 71 (which in FIG. 26 are obscured by the power supply). System 131 also includes a generally annular frame member 133 that extends radially inwardly from member 63 toward hub 51 (also obscured) to provide further physical protection for the cooling fins. Member 133 includes an array of apertures for facilitating air flow about the cooling fins.

A further embodiment of a space light system is illustrated in FIGS. 27 to 30, where corresponding features are denoted by corresponding reference numerals. More particularly, the space light system 135 makes use of generally circumferentially arranged cooling fins that are grouped in arrays about extending radially outwardly from the respective modules. In this embodiment the cooling fins are collectively formed by die casting and, more preferably, by squeeze casting (that is, high density die casting). That is, the fins are collectively formed from alumimium that is cast into the desired shape. In this embodiment the alumimum is cast around the heat pipes in the mould. In other embodiments, two separate mating pieces of alumimium are cast, with opposed formations to complementarily receive the heatpipes. The two pieces are positioned to sandwich the heatpipes and then adhered and/or mechanically secured together (with bolts, screws or other such fasteners).

In other embodiments use is made of other moulded materials such as ceramics or polymers.

System 135 includes a semi-circular aluminium yoke 136 that is rotatably attached to member 63 for allowing mounting of system 135 to other structures.

Figure 30:
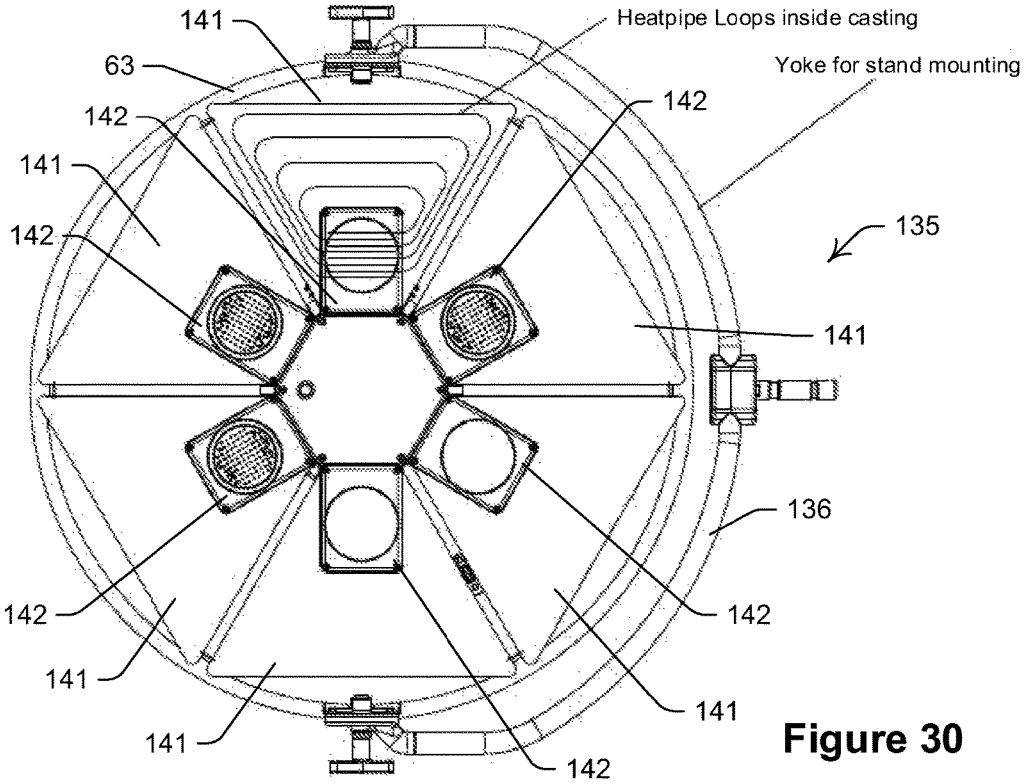
FIG. 30 is an underside view of the system of FIG. 27 omitting selected details so as to illustrate by example the configuration of the heatpipes.

As best shown in FIG. 30, system 135 includes six radially diverging arrays 141 of integrally formed generally circumferentially extending cooling fins that are associated with respective modules 142. It will be appreciated that considerable detail has been selectively omitted in this Figure to demonstrate primarily the configuration of the heatpipes for each of the modules. In particular, the heat conductors used in system 135, while having ends—that is, a first end at the module and a second end at the fins—are defined by heatpipes that are formed in loops. Accordingly, system 135 includes heat conductors having the first end and the second end of each heat conductor connected to the first end and the second end of another heat conductor to form a loop. Moreover, the loop configuration of the array of heatpipes used by each module is shown only for one of the six modules (the topmost as shown in FIG. 30). It will be appreciated that the arrays of heatpipes for the other modules are the same in this embodiment. In other embodiments different configurations are used, for example, where the system is optimised for other than substantially horizontal placement.

Figure 28:
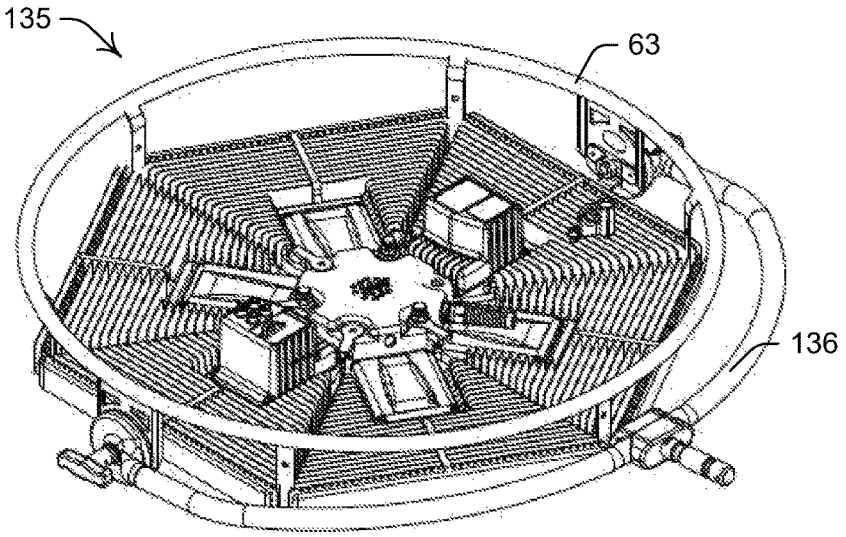
FIG. 28 is a perspective view of the system of FIG. 27.
Figure 29:
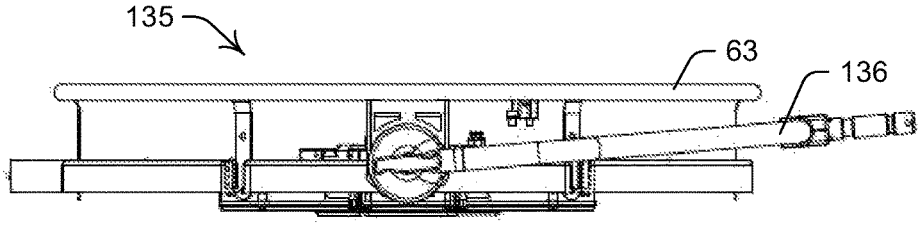
FIG. 29 is a side view of the system of FIG. 27.

It will be noted particularly from FIG. 29 that this embodiment of system 135 offers a very low profile—that is, its vertical height, as shown in FIG. 29 is less than, for example, the corresponding height of system 1 as illustrated in FIG. 3. This embodiment of FIGS. 27 to 30 is, in some respects, a combination of the radial configuration of the system of FIG. 1 and the lower profile configuration of the system of FIG. 15.

The use of high pressure die casting allows for intricate and yet strong fin shapes to be formed.

Although the fins illustrated in FIG. 28 are shown to extend generally circumferentially, in other embodiments those fins extend radially, or a combination of radially and circumferentially. In further embodiments other fin orientations are used.

Although in the FIG. 28 embodiment the collectively formed fins give rise to an overall triangular shape—for example, as viewed from below in FIG. 30—in other embodiments different shapes, either simple or complex are used. Accordingly, considerable design flexibility is afforded by the use of this manufacturing process.

The main advantages of the embodiments described above include:

- A compact, high power, passive space light.
- Energy efficient production of light.
- Space efficient production of light.
- A lightweight construction to facilitate handling, assembly and disassembly.
- Has a form factor based around common industry dimensions for allowing use of existing space light accessories such as skirts, diffusers and other such components.
- Closely spaced apart LED arrays for allowing improved mixing of different coloured light to form a uniform beam.
- Passive cooling and hence low noise. Accordingly, the embodiments are suitable for use in a wide variety of environments.
- Modular design for allowing individual replacement of components.
- Robust, lightweight design.
- Sealing between the modules and the hub allows use of embodiments in harsh and wet environments. For example to provide lighting in rain, chance storms, or around wet areas such as nearby pools, or in snow, sleet, or other adverse weather conditions.
- More thoroughly sealed embodiments are also suitable for in-water and underwater use.
- The use of an open frame for improved passive cooling and low thermal mass.
- All electrical equipment (such as control circuits for LED arrays, and central controllers for mixing light from those arrays) is housed either within the modules or within the hub.
- The central hub facilitates distribution of power from a single power source to all modules.
- Pins on the hub provide both ease of releasable connection to a corresponding fitting, where that fitting is, in some embodiments, part of a power source for the lighting system.

It will be appreciated that the disclosure above provides various significant lighting systems and methods of lighting.

It should be appreciated that in the above description of exemplary embodiments of the invention, various features of the invention are sometimes grouped together in a single embodiment, Figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those skilled in the art. For example, in the following claims, any of the claimed embodiments can be used in any combination.

In the description provided herein, numerous specific details are set forth. However, it is understood that embodiments of the invention may be practiced without these specific details. In other instances, well-known methods, structures and techniques have not been shown in detail in order not to obscure an understanding of this description.

Similarly, it is to be noticed that the term "coupled" or "connected", when used in the description and claims, should not be interpreted as being limited to direct connections only. The terms "coupled" and "connected," along with their derivatives, may be used. It should be understood that these terms are not intended as synonyms for each other. Thus, the scope of the expression "a device A coupled to a device 6" should not be limited to devices or systems wherein an output of device A is directly connected to an input of device B. Rather, it means that there exists a path between an output of A and an input of B which may be a path including other devices or means. "Coupled" may mean that two or more elements are either in direct physical or electrical contact, or that two or more elements are not in direct contact with each other but yet still co-operate or interact with each other.

Thus, while there has been described what are believed to be the preferred embodiments of the invention, those skilled in the art will recognize that other and further modifications may be made thereto without departing from the spirit of the invention, and it is intended to claim all such changes and modifications as falling within the scope of the invention. For example, any formulas or flowcharts provided are merely representative of procedures that may be used. Functionality may be added or deleted from the block diagrams and operations may be interchanged among functional blocks. Steps may be added or deleted to methods described within the scope of the present invention.

The invention claimed is:

1. A lighting system including:

a plurality of modules for emitting light, wherein the modules are adjacent to each other and the light collectively defines a beam of light that is directed along a primary axis in a first direction;

a plurality of heat conductors for allowing heat to be drawn away from the modules, each heat conductor having a first end that is thermally connected to one of the modules and a second end that is spaced apart from the first end; and a plurality of heat exchange elements that are spaced apart from the modules and thermally connected with the second ends for allowing the heat to be dissipated from the heat conductors, wherein the elements extend radially away from the modules and include an array of heat exchange fins that each have first and second free edges that are spaced apart along the primary axis.

2. A system according to claim 1 wherein the modules each include a window through which light is emitted and the windows extend substantially along a common plane.

3. A system according to claim 2 wherein the modules each include respective arrays of LEDs for generating the light that is emitted through the corresponding window.

4. A system according to claim 2 wherein the common plane is normal to the primary axis.

5. A system according to claim 2 wherein the windows are covered by respective lenses.

6. A system according to claim 1 wherein the plurality of modules includes an even number of modules arranged in an array, wherein each module in the array is adjacent to at least two other modules.

7. A system according to claim 6 wherein the array is a circular array and diametrically opposed pairs of modules in the array are like modules.

8. A system according to claim 7 wherein like modules emit light of substantially the same colour.

9. A system according to claim 1 wherein the heat exchange elements are axially offset from the modules in a second direction opposite to the first direction.

10. A system according to claim 9 wherein the heat exchange elements radially overlap the modules.

11. A system according to claim 1 including a mounting hub for connecting to the modules.

12. A system according to claim 11 wherein the modules extend radially outwardly from the hub.

13. A system according to claim 12 wherein the modules extend radially away from each other.

14. A system according to claim 11 wherein the modules are equally circumferentially spaced about the hub.

15. A system according to claim 11 wherein the hub includes a hub housing for defining a hub cavity, the modules include respective module housing defining module cavities, and electrical equipment is able to extend between the hub cavity and the module cavities.

16. A system according to claim 1 including a mounting formation for allowing mounting of the system to another object.

17. A system according to claim 16 wherein the mounting formation includes a mounting frame.

18. A system according to claim 17 wherein the mounting frame includes at least one circumferential member and a plurality of spokes that are connected to the circumferential member and which extend radially inwardly.

19. A lighting system, comprising:

a plurality of modules for emitting light, wherein the modules are adjacent to each other and the light collectively defines a beam of light that is directed along a primary axis in a first direction;

a plurality of heat conductors for allowing heat to be drawn away from the modules, each heat conductor having a first end that is thermally connected to one of the modules and a second end that is spaced apart from the first end;

a plurality of heat exchange elements that are spaced apart from the modules and thermally connected with the second ends for allowing the heat to be dissipated from the heat conductors, wherein the elements extend radially away from the modules; and a mounting hub for connecting to the modules, wherein the hub includes a hub housing for defining a hub cavity, the modules include respective module housing defining module cavities, and electrical equipment is able to extend between the hub cavity and the module cavities, wherein each module housing includes an engagement face having a module aperture and the hub housing includes an outer face having a plurality of hub apertures corresponding to the number of modules, the outer face being engagable with the engagement faces such that each module aperture is aligned with a respective hub aperture.

20. A system according to claim 19 wherein the outer face is sealingly engageable with the engagement faces.

* * * * *